US006945615B1

(12) United States Patent
Cain

(10) Patent No.: US 6,945,615 B1
(45) Date of Patent: Sep. 20, 2005

(54) VERTICAL PEG BOARD SHELF SYSTEM

(76) Inventor: Leo Cain, 2200 Henerick Pl., Clearwater, FL (US) 33765

( * ) Notice: Subject to any disclaimer, the term of this patent is extended or adjusted under 35 U.S.C. 154(b) by 96 days.

(21) Appl. No.: 10/677,047

(22) Filed: Oct. 1, 2003

(51) Int. Cl.[7] ..... A47B 97/00
(52) U.S. Cl. ..... 312/249.8; 312/334.28
(58) Field of Search ..... 312/249.1, 249.6, 312/249.8, 249.13, 213, 294, 334.24, 334.25, 312/334.28, 350, 902

(56) References Cited

U.S. PATENT DOCUMENTS

| | | | | | |
|---|---|---|---|---|---|
| 2,608,305 | A | * | 8/1952 | Sager | 211/49.1 |
| 2,660,506 | A | * | 11/1953 | Wright | 312/306 |
| 2,758,904 | A | * | 8/1956 | Hansell et al. | 312/334.24 |
| 3,135,570 | A | * | 6/1964 | Erismann | 312/311 |
| 3,269,550 | A | * | 8/1966 | Marcus | 211/70.6 |
| 3,664,719 | A | * | 5/1972 | Berg | 312/185 |
| 4,240,684 | A | * | 12/1980 | Henning | 312/202 |
| 4,753,495 | A | * | 6/1988 | Swink | 312/114 |
| 5,468,063 | A | * | 11/1995 | Simonek | 312/334.28 |
| 5,588,659 | A | * | 12/1996 | Boes et al. | 280/47.19 |
| 6,135,584 | A | * | 10/2000 | Happ | 312/330.1 |
| 6,394,566 | B1 | * | 5/2002 | Slivon et al. | 312/323 |

FOREIGN PATENT DOCUMENTS

| | | | | |
|---|---|---|---|---|
| CH | 358208 | * | 12/1961 | 312/334.25 |
| DE | 216707 | * | 8/1961 | 312/312 |

* cited by examiner

*Primary Examiner*—James O. Hansen
(74) *Attorney, Agent, or Firm*—Edward P. Dutkiewicz

(57) ABSTRACT

A cabinet is provided in a rectilinear configuration. A plurality of U-shaped rails is secured to, and faces upwardly from, the bottom with a plurality of inverted U-shaped rails secured to, and faces downwardly from, the top, and a plurality of slidable peg board sheets between a U-shaped rail and an inverted U-shaped rail. Aligned rows and columns of horizontal apertures are provided through the slidable peg board sheets with associated hooks. The hooks are selectively positionable by a user.

1 Claim, 3 Drawing Sheets

VERTICAL PEG BOARD SHELF SYSTEM

BACKGROUND OF THE INVENTION

1. Field of the Invention

The present invention relates to a vertical peg board shelf system and more particularly pertains to removably storing tools and the like on fixed and slidable supports in a safe and convenient manner.

2. Description of the Prior Art

The use of storage assemblies of known designs and configurations is known in the prior art. More specifically, storage assemblies of known designs and configurations previously devised and utilized for the purpose of storing tools and the like through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,758,904 issued Aug. 14, 1956 to Hansel relates to a pan rack assembly. U.S. Pat. No. 2,923,584 issued Feb. 2, 1960 to Broderick relates to a cabinet assembly. U.S. Pat. No. 4,179,724 issued Dec. 18, 1979 to Bonhomme relates to cabinets for electrical or electronic equipment. U.S. Pat. No. 5,468,063 issued Nov. 21, 1995 to Simonek relates to an accessories organizer. U.S. Pat. No. 5,992,956 issued Nov. 30, 1999 to Slivon relates to inclined slide assemblies for vertical drawers. U.S. Pat. No. Des. 289.350 issued Apr. 21, 1987 to Cordero relates to a combined clothes storage unit and lamp.

While these devices fulfill their respective, particular objectives and requirements, the aforementioned patents do not describe a vertical peg board shelf system that allows removably storing tools and the like on slidable supports in a safe and convenient manner.

In this respect, the vertical peg board shelf system according to the present invention substantially departs from the conventional concepts and designs of the prior art, and in doing so provides an apparatus primarily developed for the purpose of removably storing tools and the like on slidable supports in a safe and convenient manner.

Therefore, it can be appreciated that there exists a continuing need for a new and improved vertical peg board shelf system which can be used for removably storing tools and the like on slidable supports in a safe and convenient manner. In this regard, the present invention substantially fulfills this need.

SUMMARY OF THE INVENTION

In view of the foregoing disadvantages inherent in the known types of storage assemblies of known designs and configurations now present in the prior art, the present invention provides an improved vertical peg board shelf system. As such, the general purpose of the present invention, which will be described subsequently in greater detail, is to provide a new and improved vertical peg board shelf system and method which has all the advantages of the prior art and none of the disadvantages.

To attain this, the present invention essentially comprises a cabinet. The cabinet is in a rectilinear configuration. The cabinet has a rectangular front face 16 and a parallel rectangular rear face. The cabinet has a rectangular first side face and a parallel rectangular second side face. The cabinet also has a horizontal top panel and a horizontal bottom panel. The cabinet further has a fixed sheet of peg board covering each side face.

A plurality of U-shaped rails is secured to and faces upwardly from, the bottom panel with a plurality of inverted U-shaped rails and faces downwardly from the top panel. The U-shaped rails and the inverted U-shaped rails are in vertical alignment. A plurality of slidable peg board sheets 36 are provided. Each sheet is supported between a U-shaped rail and an inverted U-shaped rail. The peg board sheets are selectively slidable between a storage orientation and a utilization orientation. In the storage orientation, the peg board sheets are totally within the cabinet. In the utilization orientation the peg board sheets are partially withdrawn from the cabinet through the front face.

Provided next are aligned rows and columns of horizontal apertures. The apertures are provided through the fixed sheets of peg board and slidable peg board sheets. The apertures have associated hooks. The hooks are selectively positionable by a user in the apertures for removably supporting tools and the like.

Further provided is a plurality of wheels. There are preferably four wheels, one at each corner. The wheels depend from the bottom panel. In this manner movement of the cabinet is facilitated which facilitates removal and replacement of tools and the like from all sides of the cabinet.

Provided last is a plurality of horizontal bars. There are three in the preferred embodiment. The bars partially cover the rear face. The bars are spaced one above the other. A tool support is secured to each bar. Each tool support has three horizontal tiers. Each tier has vertical apertures. The vertical apertures are of various sizes, shapes and orientations. Such apertures include circles, ovals and rectangles and the like. The vertical apertures are provided for removably supporting tools and the like.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vertical peg board shelf system which has all of the advantages of the prior art storage assemblies of known designs and configurations and none of the disadvantages.

It is another object of the present invention to provide a new and improved vertical peg board shelf system which may be easily and efficiently manufactured and marketed.

It is further an object of the present invention to provide a new and improved vertical peg board shelf system which is of durable and reliable constructions.

An even further object of the present invention is to provide a new and improved vertical peg board shelf system which is susceptible of a low cost of manufacture with regard to both materials and labor, and which accordingly is then susceptible of low prices of sale to the consuming public, thereby making such vertical peg board shelf system economically available to the buying public.

Even still another object of the present invention is to provide a vertical peg board shelf system for removably storing tools and the like on slidable supports in a safe and convenient manner.

Lastly, it is an object of the present invention to provide a new and improved vertical peg board shelf system. A cabinet is provided in a rectilinear configuration. A plurality of U-shaped rails is secured to, and faces upwardly from, the bottom with a plurality of inverted U-shaped rails secured to, and faces downwardly from, the top, and a plurality of slidable peg board sheets between a U-shaped rail and an inverted U-shaped rail. Aligned rows and columns of horizontal apertures are provided through the slidable peg board sheets with associated hooks. The hooks are selectively positionable by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
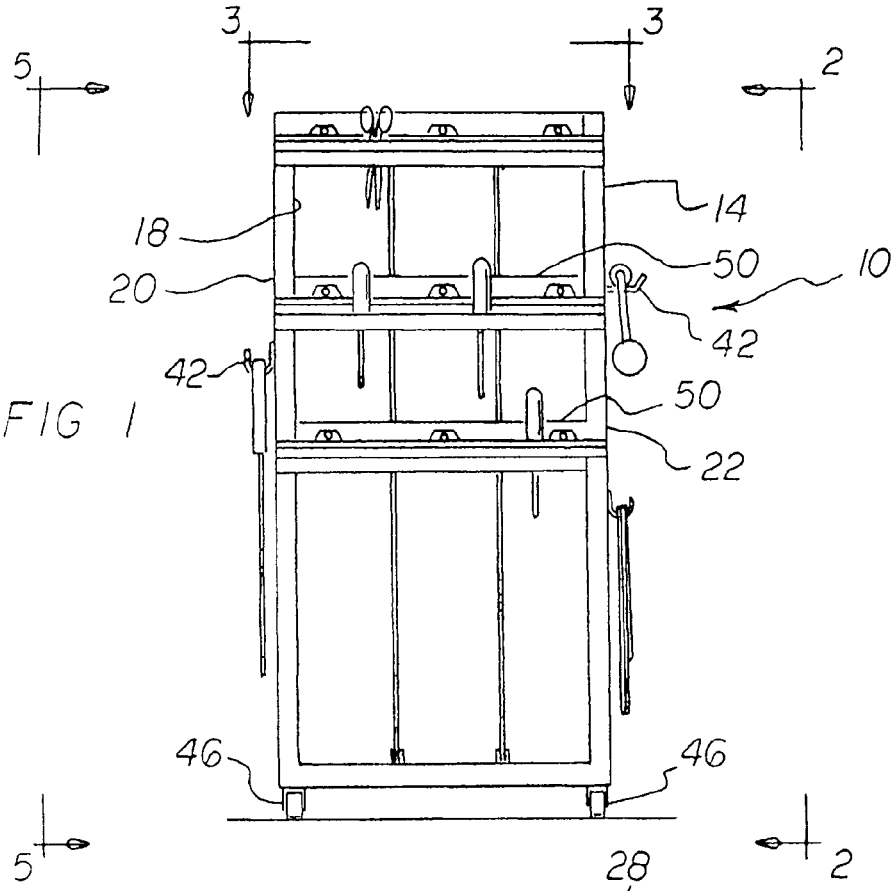
FIG. 1 is a rear elevational view of a vertical peg board shelf system constructed in accordance with the principles of the present invention.
Figure 2:
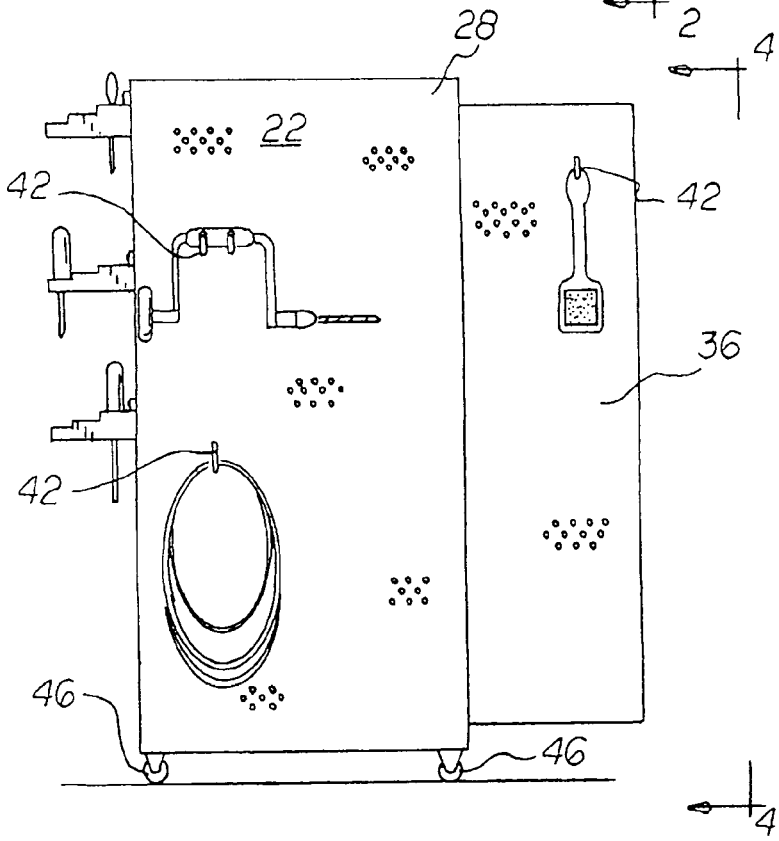
FIG. 2 is a left side elevational view of the system taken at line 2—2 of FIG. 1.
Figure 3:
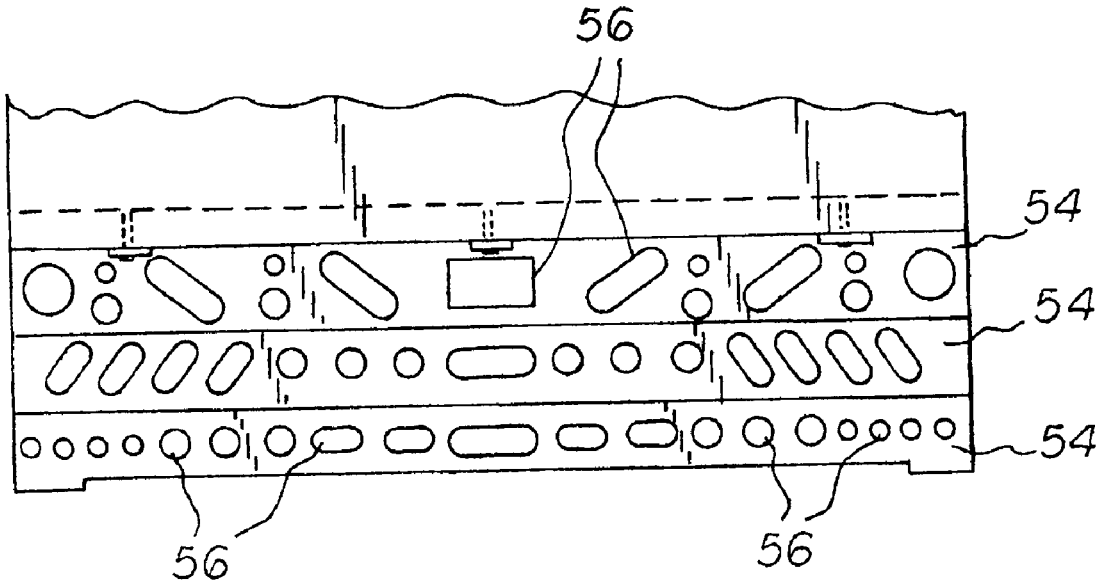
FIG. 3 is a partial plan view of the system taken at line 3—3 of FIG. 1.
Figure 4:
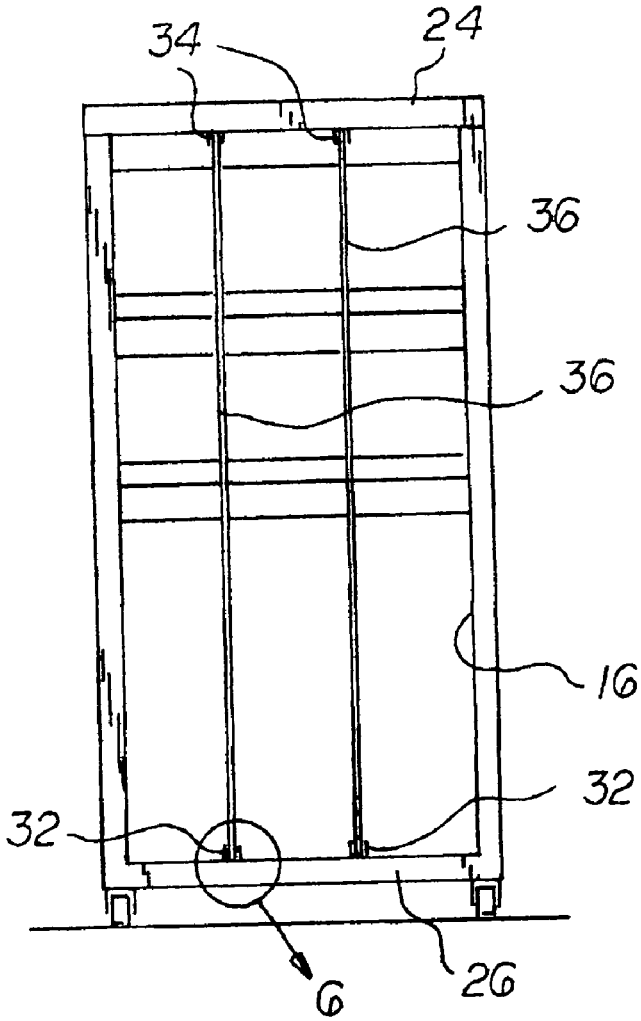
FIG. 4 is a front elevational view of the system taken at line 4—4 of FIG. 1.
Figure 5:
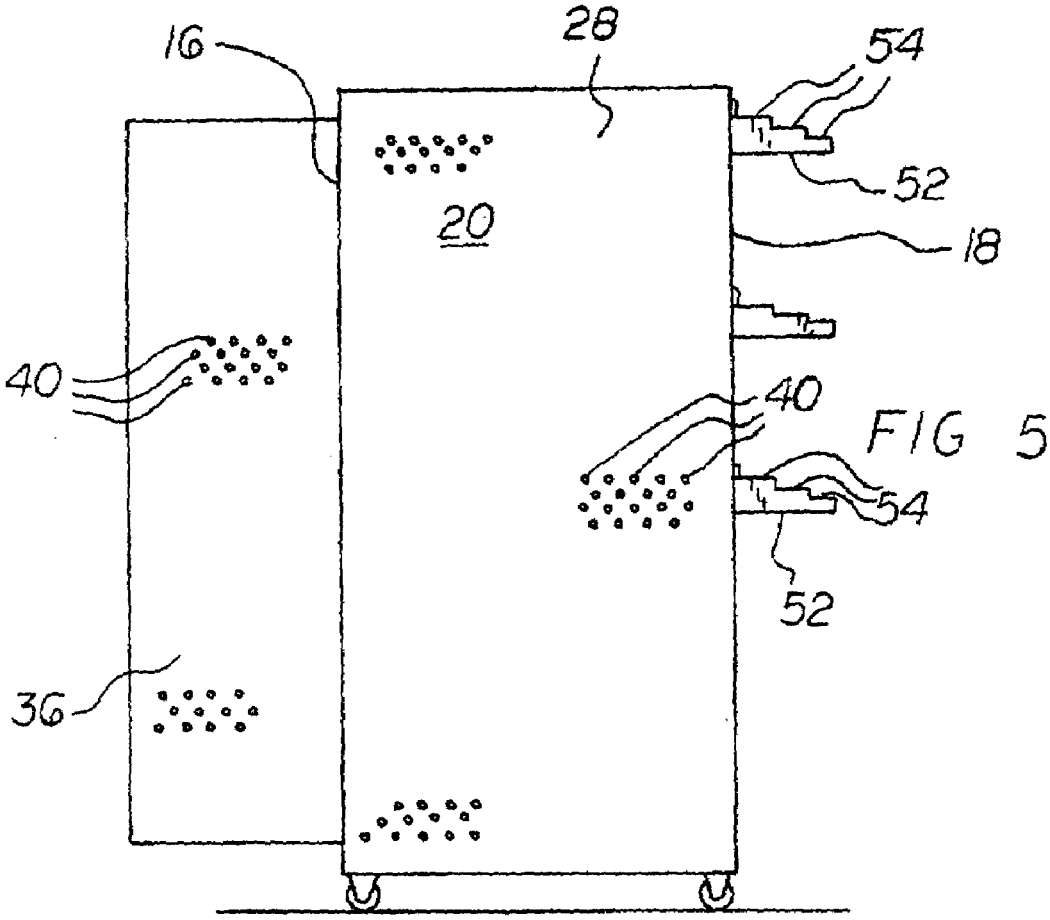
FIG. 5 is a right side elevational view of the system taken at line 5—5 of FIG. 1.
Figure 6:
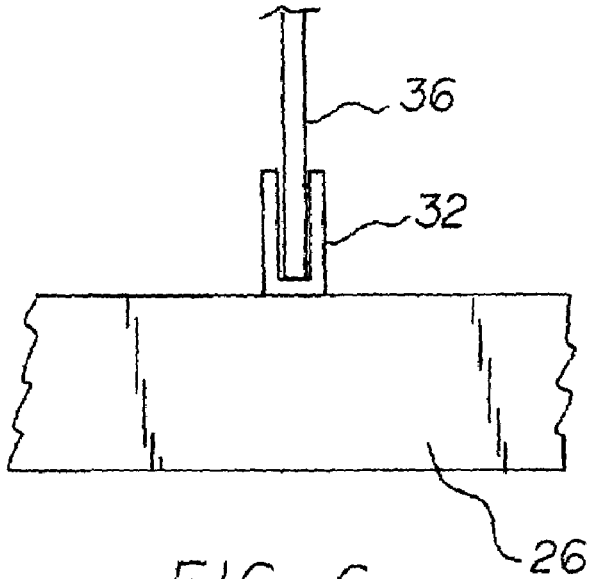
FIG. 6 is an enlarged side elevational view of the system taken at circle 6 of FIG. 4.

With reference now to the drawings, and in particular to FIG. 1 thereof, the preferred embodiment of the new and improved vertical peg board shelf system embodying the principles and concepts of the present invention and generally designated by the reference numeral 10 will be described.

The present invention, the vertical peg board shelf system 10 is comprised of a plurality of components. Such components in their broadest context include a cabinet, a plurality of U-shaped rails, and aligned rows and columns of horizontal apertures. Such components are individually configured and correlated with respect to each other so as to attain the desired objective.

First provided is a cabinet 14. The cabinet is in a rectilinear configuration. The cabinet has a rectangular front face 16 and a parallel rectangular rear face 18. The cabinet has a rectangular first side face 20 and a parallel rectangular second side face 22. The cabinet also has a horizontal top panel 24 and a horizontal bottom panel 26. The cabinet further has a fixed sheet of peg board 28 covering each side face.

A plurality of U-shaped rails 32 is secured to and faces upwardly from, the bottom panel with a plurality of inverted U-shaped rails 34 and faces downwardly from the top panel. The U-shaped rails and the inverted U-shaped rails are in vertical alignment. A plurality of slidable peg board sheets 36 are provided. Each sheet is supported between a U-shaped rail and an inverted U-shaped rail. The peg board sheets are selectively slidable between a storage orientation and a utilization orientation. In the storage orientation, the peg board sheets are totally within the cabinet. In the utilization orientation the peg board sheets are partially withdrawn from the cabinet through the front face.

Provided next are aligned rows and columns of horizontal apertures 40. The apertures are provided through the fixed sheets of peg board and slidable peg board sheets. The apertures have associated hooks 42. The hooks are selectively positionable by a user in the apertures for removably supporting tools and the like.

Further provided is a plurality of wheels 46. There are preferably four wheels, one at each corner. The wheels depend from the bottom panel. In this manner movement of the cabinet is facilitated. The movement of the cabinet facilitates removal and replacement of tools and the like from all sides of the cabinet with three of the four sides of the cabinet being different from the other sides.

Provided last is a plurality of horizontal bars 50. There are three in the preferred embodiment. The bars partially cover the rear face. The bars are spaced one above the other. A tool support 52 is secured to each bar. Each tool support has three horizontal tiers 54. Each tier has vertical apertures 56. The vertical apertures are of various sizes, shapes and orientations. Such apertures include circles, ovals and rectangles and the like. The vertical apertures are provided for removably supporting tools and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vertical peg board shelf system for removably storing tools on fixed and slidable supports in a safe and convenient manner comprising, in combination:

a cabinet in a rectilinear configuration with a rectangular front face and a parallel rectangular rear face, and with a rectangular first side face and a parallel rectangular second side face, and with a horizontal top panel and a horizontal bottom panel, and with a fixed sheet of peg board covering each side face;

a plurality of U-shaped rails secured to, and facing upwardly from, the bottom panel with a plurality of inverted U-shaped rails secured to, and facing downwardly from, the top panel, the U-shaped rails and the inverted U-shaped rails being in vertical alignment, and a plurality of slidable peg board sheets with each sheet supported between a U-shaped rail and an inverted U-shaped rail, the peg board sheets selectively slidable between a storage orientation totally within the cabinet and a utilization orientation partially withdrawn from the cabinet through the front face;

aligned rows and columns of horizontal apertures through the fixed sheets of peg board and slidable peg board sheets with associated hooks selectively positional by a user in the apertures for removably supporting tools;

a plurality of wheels depending from the bottom panel to facilitate movement of the cabinet and also facilitate removal and replacement of tools from all sides of the cabinet; and a plurality of horizontal bars partially covering the rear face and spaced one above the other, and with a tool support secured to each bar, each tool support having three horizontal tiers with each tier having vertical apertures of various sizes and shapes and orientations for removably supporting tools.

* * * * *